US011506353B2

(12) United States Patent
Hallitschke

(10) Patent No.: US 11,506,353 B2
(45) Date of Patent: Nov. 22, 2022

(54) LIGHT GUIDE FOR LAMPS, LAMP FOR AUTOMOBILES AND ASSEMBLING METHOD OF SAID LIGHT GUIDE

(71) Applicant: OLSA S.p.A., Rivoli-Cascine Vica To (IT)

(72) Inventor: Frank Hallitschke, Rivoli-Cascine Vica To (IT)

(73) Assignee: OLSA S.P.A., Rivoli To (IT)

( * ) Notice: Subject to any disclaimer, the term of this patent is extended or adjusted under 35 U.S.C. 154(b) by 0 days.

(21) Appl. No.: 17/349,383

(22) Filed: Jun. 16, 2021

(65) Prior Publication Data

US 2021/0404620 A1 Dec. 30, 2021

(30) Foreign Application Priority Data

Jun. 25, 2020 (IT) ..... 102020000015274

(51) Int. Cl.
*F21S 41/24* (2018.01)
*F21S 41/29* (2018.01)

(52) U.S. Cl.
CPC ..... *F21S 41/24* (2018.01); *F21S 41/29* (2018.01)

(58) Field of Classification Search
CPC .. F21S 41/24; F21S 41/29; F21S 41/20; F21S 41/00
USPC ..... 362/459
See application file for complete search history.

(56) References Cited

U.S. PATENT DOCUMENTS 4,729,185 A * 3/1988 Baba ..... G02B 6/0055 40/546
6,174,079 B1 * 1/2001 Buard ..... G02B 6/001 362/346
2011/0058385 A1 * 3/2011 Kazaoka ..... B60Q 1/2665 362/540
2015/0117001 A1 * 4/2015 Fan ..... H05K 1/189 29/850

* cited by examiner

*Primary Examiner* — Andrew J Coughlin
*Assistant Examiner* — Jessica M Apenteng
(74) *Attorney, Agent, or Firm* — Dickinson Wright PLLC

(57) ABSTRACT

A light guide for a lamp of an automobile includes at least one body made of elastic material adapted to conduct, at least partly, light rays within itself by total internal reflection; a supporting structure adapted to connect the at least one body to the lamp. The body comprises: at least one light inlet portion, from which the light rays emitted by at least one light source enter the body; a plurality of light emission portions, from which the light rays exit the light guide, so as to be visible to an observer. The light guide comprises at least two connection elements adapted to permit fastening the body to the supporting structure. The body includes at least one pliable portion between the at least two connection elements so that the body can be bent and/or curved to take a plurality of different conformations.

11 Claims, 8 Drawing Sheets

Fig.4A
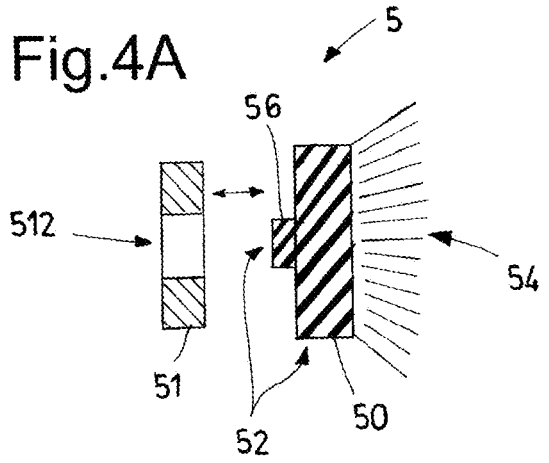
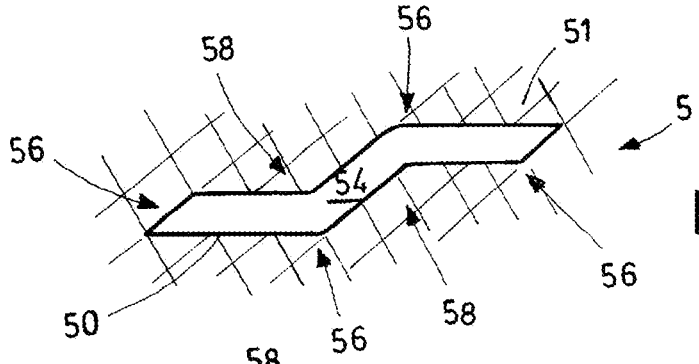
Fig.4B
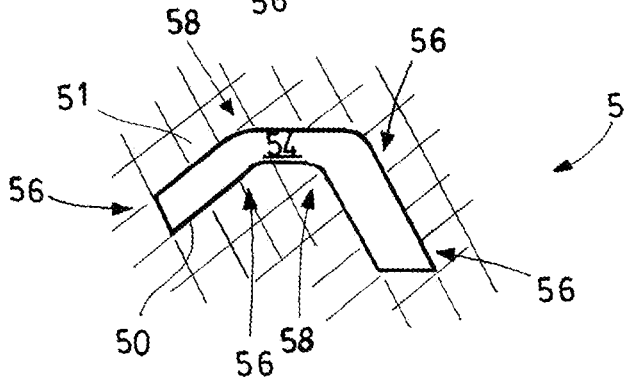
Fig.4C
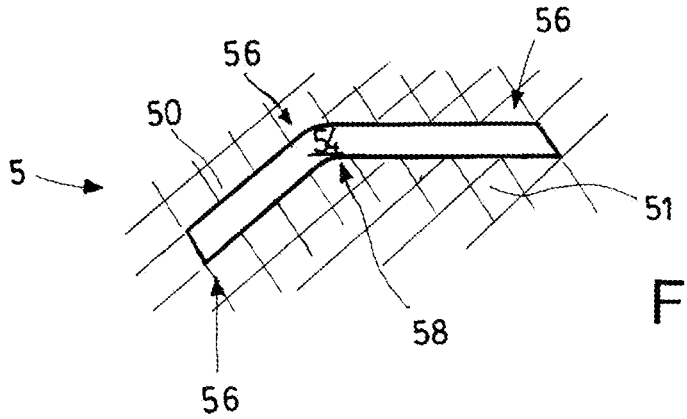
Fig.4D

LIGHT GUIDE FOR LAMPS, LAMP FOR AUTOMOBILES AND ASSEMBLING METHOD OF SAID LIGHT GUIDE

CROSS-REFERENCE TO RELATED APPLICATION

This application claims the benefit of Italian (IT) Patent Application Serial No. 102020000015274, filed Jun. 25, 2020, which is incorporated herein by reference in its entirety.

FIELD

The present disclosure relates generally to lamps for automobiles. The present disclosure relates more specifically to light guides for lamps, and methods of assembling lamps with such light guides.

BACKGROUND

This section provides background information related to light guides to provide a better understanding of currently available configurations and adaptations of such light guides and methods of assembling light guides. However, the information provided in this section is not necessarily considered to be prior art with respect to the inventive concepts associated with the present disclosure.

In the automotive industry, it is desirable to reduce production costs for manufacturing the various components of a vehicle. There is also an increasing demand for vehicle components that can be customized without the need for customized engineering. For example, it is desirable to provide vehicle components capable of displaying different optical and/or visual effects. Such effects may be used, for example, to customize different car models using standardized components. Furthermore, it is desirable to use standardized components for several different applications, without having to design specific components for each application.

Conventional light guides for vehicle lamps require material to be removed in order to obtain a different conformation starting from a standardized initial shape. Furthermore, conventional light guides typically cannot be bent or curved in order to modify their conformation and to obtain a different optical effect once the light guide has been appropriately assembled in a lamp. In fact, it has become common in the industry to design the light guide specifically for a given function, and a light guide employed in a way other than the one it was engineered for, would give poor performance; for example, a simple 180° rotation about an axis would turn out to be deleterious for the performance of conventional light guides.

SUMMARY

This section provides a general summary of some of the objects, advantages, aspects and features provided by the inventive concepts associated with the present disclosure. However, this section is not intended to be considered an exhaustive and comprehensive listing of all such objects, advantages, aspects and features of the present disclosure.

In one aspect, the present disclosure is directed to a light guide for a lamp of an automobile. The light guide comprises: at least one body made of an elastic material and adapted to conduct, at least partly, light rays within itself by total internal reflection; a supporting structure, adapted to connect the at least one body to the lamp. The at least one body includes: at least one light inlet portion, from which light rays emitted by at least one light source enter the at least one body, and a plurality of light emission portions from which the light rays at least partly conducted in the at least one body exit the light guide, so as to be visible to an observer. The light guide also comprises at least two connection elements adapted to fasten the at least one body to the supporting structure; and at least one pliable portion located between the at least two connection elements and providing for the at least one body to deform into a plurality of different conformations, and allowing the at least two connection elements to move relative to each other. The at least two connection elements interact with the supporting structure to hold the at least one body of the light guide in a selected conformation.

In another aspect, the present disclosure is directed to a method for assembling a light guide for a lamp of an automobile. The method comprises: positioning at least one body of the light guide onto a supporting structure with a selected conformation by at least one of bending or curving said at least one body; and coupling at least two connection elements of the body to a supporting structure to maintain the at least one body in the selected conformation.

Further areas of applicability will become apparent from the description provided herein. As noted, the description and any specific examples in this summary are intended for purposes of illustration only and are not intended to limit the scope of the present disclosure.

BRIEF DESCRIPTION OF THE DRAWINGS

Other advantages of the present embodiments will be readily appreciated, as the same becomes better understood by reference to the following detailed description and appended claims when considered in connection with the accompanying drawings, wherein:

FIGS. 4A-4D show a first example configuration of a light guide according to the present disclosure, wherein the supporting structure is located on the face opposite to the light emission portion of the light guide, and the body assumes a first configuration; in particular, FIG. 4A shows a sectional view illustrating a coupling between the body and the supporting structure; FIGS. 4B-4D show the illuminated zones of the light guide, in particular the light emission portion, in the different conformations shown in FIGS. 3A-3C;

FIG. 5A shows the coupling between the body and the supporting structure; FIGS. 5B-5D show the illuminated zones of the light guide, in particular the plurality of light emission portions, in the different conformations shown in FIGS. 3A-3C;

FIG. 6A shows a sectional view illustrating a coupling between the body and the supporting structure; FIGS. 6B-6D show the illuminated zones of the light guides, in particular the light emission portion, in the different conformations shown in FIGS. 3A-3C;

FIG. 7A shows a sectional view illustrating the coupling between the body and the supporting structure; FIGS. 7B-7D show the illuminated zones of the light guide, in particular the plurality of light emission portions, in the different conformations shown in FIGS. 3A-3C;

FIG. 8A shows a sectional view of the lamp portion; and FIG. 8B shows a front view of the lamp portion.

DETAILED DESCRIPTION OF EXAMPLE EMBODIMENTS

Figure 1:
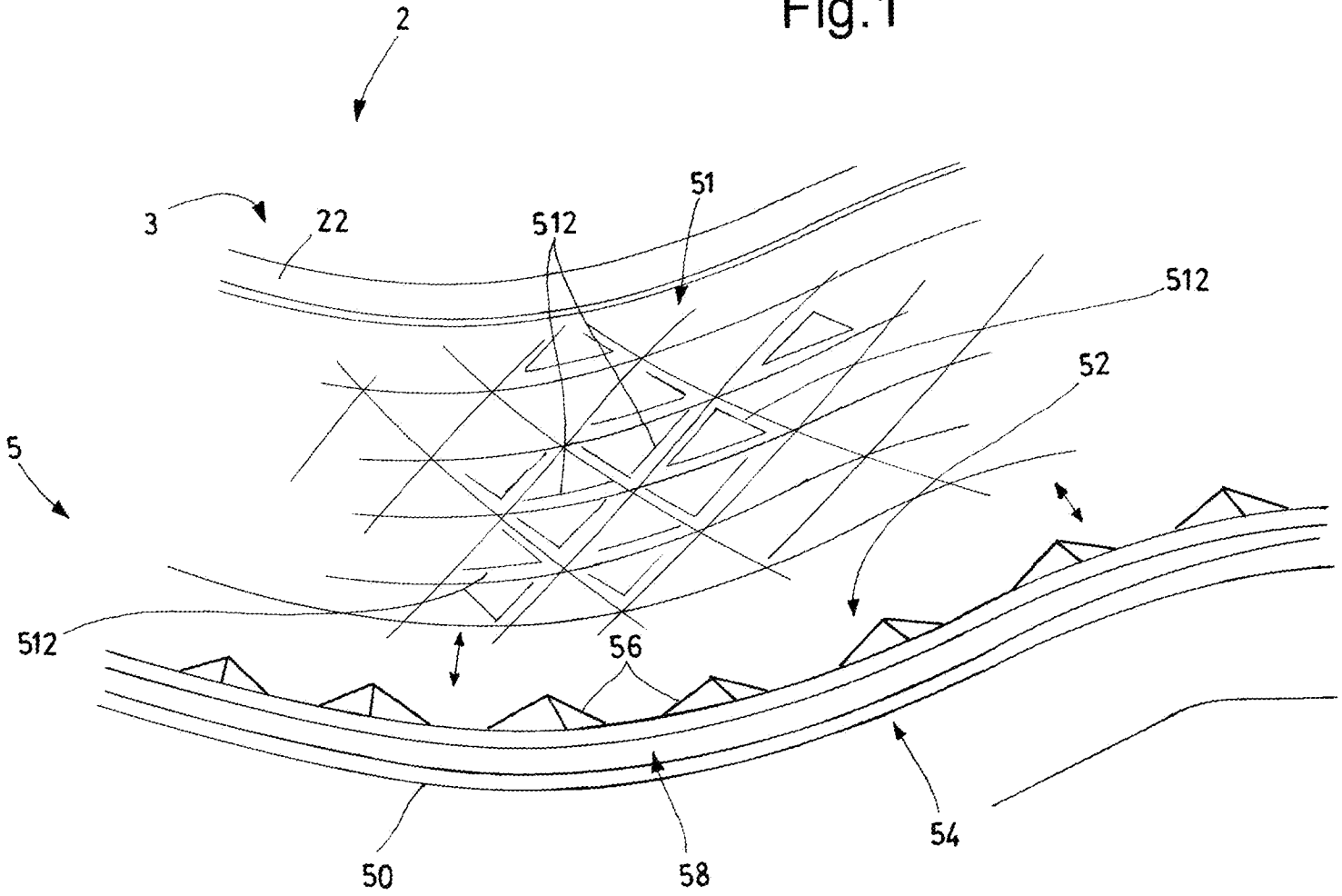
FIG. 1 shows a perspective view of a light guide for a lamp, in accordance with one aspect of the disclosure.

The example embodiments will now be described more fully with reference to the accompanying drawings.

One or more example embodiments of lamps for automobiles, and light guides for such lamps are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure provides a light guide made of a material having high elasticity and good light conduction properties, such as, for example, silicone, which can take different structural configurations starting from a basic or standard structure, so that its shape can be adapted to obtain a final conformation suitable for a lamp in which such light guide will have to be installed.

The present disclosure also provides a lamp for automobiles. The lamp includes a light guide capable of changing its own conformation to provide the desired lamp appearance.

Finally, the disclosure also provides a method for assembling a light guide, e.g. in a lamp, so that it will take the desired conformation.

With reference to the above-mentioned figures, reference numeral 5 designates, as a whole, the light guide according to the present disclosure. Reference numeral 2 designates a lamp for a vehicle, as a whole. The light guide 5 may be particularly suitable for application to lamps 2 for use on vehicles, such as boats or automobiles, which may include passenger cars and trucks.

The light guide 5 includes at least one body 50 adapted to conduct, at least partly, light rays within itself by total internal reflection. The light guide 5 also includes at least one supporting structure 51 adapted to allow the body 50 of light guide 5 to be connected to the lamp 2.

FIG. 1 shows a car lamp 2 having one light guide 5 with one body 50. The body 50 includes at least one light inlet portion 52, from which the light rays emitted by at least one light source 3 enter the body 50; a plurality of light emission portions 54, from which the light rays at least partly conducted in the body 50 exit the light guide 5, so as to be visible to an observer.

The body 50 is, at least partly, made of elastic material which is capable of conducting light within itself by internal reflection. The elastic material may be a material having good elastic properties, e.g. an elastomer material. In some embodiments, the body 50 is totally made of the elastic material. The elastic material may include, for example, a polymer, e.g. polymers using semiconductor materials, preferably comprising long chains of oxides of a semiconductor material, alkyl groups and aryl groups bound by atoms of the semiconductor material. The elastic material may include silicone-based materials or thermoplastic elastomer materials. In some embodiments, the body 50 is at least partly made of a silicone-based material. In some embodiments, the body 50 is entirely made of silicone-based material.

The light guide 5 includes at least two connection elements 56. The connection elements 56 are adapted to fasten the body 50 to supporting structure 51.

In light guide 5 according to the present disclosure, the body 50 comprises, between at least two connection elements 56, at least one pliable portion 58, so that the body 50 can be bent and/or curved to take a plurality of different conformations. In particular, the at least one pliable portion 58 allows relative movement of the at least two connection elements 56 in a plane and/or in 3-dimensional space.

In light guide 5 according to the present disclosure, the interaction between the connection elements 56 and the supporting structure 51 is such that body 50 of the light guide 5 can maintain a desired conformation over time.

The at least one pliable portion 58 may allow the body 50 to change its shape, so that the light guide 5 can be bent to obtain the desired conformation. For the purposes of the present description, the expression "can be bent" refers to any deformation of the original shape of the body 50 such that the latter will change its own shape from the original shape, e.g. a curve, a bend, a fold, a twist, etc. Moreover, for the purposes of the present description, the expression "original shape" refers to the shape of body 50 when it is unstressed, unbent, and not interacting with supporting structure 51.

Preferably, such bending is applied to the pliable portion 58, which may be any portion of body 50, by exploiting the elastic properties of the materials employed for making the body, preferably silicone-based materials, so as to allow the body 50 to be bent. Alternatively, the pliable portion 58 may be a specific portion of body 50 having a reduced thickness and/or a reduced material density compared with the adjacent portions, and/or having notches and/or prefracture lines, etc. adapted to allow the body 50 to be bent.

Preferably, since light guide 5 according to the present disclosure includes at least one pliable portion 58 between the at least two connection elements 56, the body 50 can be bent and/or curved to take a plurality of different conformations. The presence of the at least one pliable portion 58 between the at least two connection elements 56 allows relative movement of the at least two connection elements 56 at least in a plane, but preferably in 3-dimensional space, thus allowing light guide 5 to assume the desired conformation. Preferably, the body 50 is designed to return to the original shape when it stops interacting with supporting structure 51, i.e. when it is idle.

In general, the light guide 5 is adapted to be coupled to at least one light source 3, the latter being adapted to emit light rays which enter the body 50 of light guide 5 through the light inlet portion 52, the latter being suitably coupled to light source 3. In some embodiments, at least one light source 3 includes at least one light-emitting diode (LED), e.g. a red-green-blue (RGB) LED.

In some embodiments, the light guide 5 includes more than one light inlet portion 52 and more than one light emission portion 54, so as to ensure that, whatever the configuration in which the body 50 is maintained by the connection elements 56 on supporting structure 51, the light guide 5 will emit light in a desired direction.

In some embodiments, the connection elements 56 are incorporated into body 50 of light guide 5. In alternative embodiments, the connection elements 56 are connected to body 50, e.g. in a removable manner, e.g. mechanically fastened to each other or via fixing means such as, for example, glue.

In some embodiments, the connection elements 56 are protrusions and/or recesses formed in the structure of the body 50. The connection elements 56 may be integrally formed with the body 50, the assembly being made as one piece, e.g. monolithic. Separating connection elements 56 from the body 50 may cause damage or breakage to the body 50. The connection elements 56 may be formed during the process of manufacturing the body 50.

The supporting structure 51 of the light guide 5 may include a plurality of connection portions 512, with each of the connection portions 512 being adapted to be coupled to at least one connection element 56 of the body 50. In some embodiments, each connection portion 512 is adapted to be coupled to only one connection element 56 of the body 50.

In an embodiment of light guide 5, according to the present disclosure, the connection portions 512 are suitably distributed over the supporting structure 51. The connection portions 512 may be distributed over the supporting structure 51 in such a way as to allow the connection elements 56 to be appropriately connected in order to maintain body 50 of the light guide 5 in any desired position, thus assuming the selected conformation. This arrangement may permit obtaining the desired conformation of light guide 5, and in particular of body 50, by suitably coupling the connection elements 56 of body 50 to connection portions 512 of connection structure 51, so that multiple conformations can be obtained, e.g. as illustrated merely by way example in FIGS. 3A-3C.

In some embodiments, the supporting structure 51 defines an orderly distribution, e.g. in a matrix fashion, of connection portions 512. Therefore, such a solution makes it possible to obtain a large number of possible configurations of body 50.

More in general, as previously specified, the connection elements 56 may be provided in several forms. In some embodiments of the light guide 5, the connection elements 56 are protrusions extending from body 50, and the connection portions 512 are holes.

The connection elements 56 may be adapted to fit into the connection portions 512 by shape coupling. Such an arrangement may hold the body 50 of the light guide 5 in a desired conformation over time. Alternatively, the connection elements 56 may be formed as recesses, e.g. holes, possibly through holes, and the connection portions 512 may be formed as protrusions extending perpendicularly to the supporting structure 51.

The body 50 of light guide 5 may have different shapes and may include one or more faces, such as flat faces. The body 50 may have an elongate shape with a triangular, square or, more in general, polygonal cross-section, optionally including rounded portions, e.g. those portions intended to act as light emission portions 54.

Depending on the configuration of light guide 5, and in particular also on the shape of body 50, the various faces and/or portions of body 50 may act as light emission portions 54 and/or as light inlet portions 52. In some embodiments, and as shown in FIGS. 4A-4D and 6A-6D, the light emission portions 54 may include any one of the faces defined by the body 50.

Furthermore, where the connection elements 56 include protrusions extending from body 50, the plurality of light emission portions 54 may include the at least two connection elements 56, as shown by way of example in FIGS. 5A-5D and 7A-7D, in addition and/or as an alternative to any other face defined by the body 50.

In some embodiments, the connection elements 56 of the body 50 are arranged on one or more faces of the body 50. For example, the connection elements 56 may be arranged on just one face of the body 50. The connection elements 56 may be arranged on a flat face of the body 50.

In some embodiments in which the connection elements 56 are protrusions extending from body 50 and the connection portions 512 are holes, the supporting structure 51 may be arranged to mask, at least partly, the light emitted by the body 50. For example, where the light emission portions 54 include the connection elements 56, the supporting structure 51 may be arranged to mask light emitted by other parts of the body 50. For example, as shown in FIGS. 5A-5D and 7A-7D, the supporting structure 51 masks part of body 50, thus allowing the user to see the light exiting the connection elements 56, which act as light emission portions 54, when the light guide 5 has been assembled, e.g. in a lamp 2, and is viewed by an external observer.

In some embodiments, the connection portions 512 are triangular holes and the connection elements 56 are protrusions with a triangular base, e.g. as illustrated in the drawings. As an alternative, the connection portions 512 may have any other shape, e.g. rectangular or square holes, and the connection elements 56 will have complementary shapes providing a shape coupling, e.g. protrusions having a rectangular or square cross-section. The connection elements 56 may include one or more parallelogram-shaped side faces.

In some embodiments, the connection portions 512 in one supporting structure 51 are all equal; likewise, the connection elements 56 of one body 50 may each be equal.

The supporting structure 51 may be made of different materials, e.g. plastic materials, or the supporting structure 51 may be provided by a printed circuit board (PCB). The supporting structure 51 may be made of silicone-based material, e.g. having greater rigidity, whether intrinsic or obtained by means of reinforcing structures, with respect to body 50, so that it can properly support the body 50.

In some embodiments, the supporting structure 51 is opaque, so that it is impenetrable to light and can be used to mask the body 50.

In some embodiments, the supporting structure 51 may comprise a plurality of connection portions 512, which initially are non-through holes, e.g. recesses or housings. The same connection portions 512, whether one, some or all of them, can be transformed into through holes, if necessary, e.g. in order to obtain the embodiments shown in FIGS. 5A and 7A. Therefore, only the connection portions 512 intended to receive the connection elements 56 that will also act as light emission portions 54 will be transformed into actual through holes, while the other ones will remain non-through holes.

The supporting structure 51 may comprise fastening elements (not shown), which permit connecting the supporting structure 51 to a lamp 2, e.g. to supporting element 22 of lamp 2.

In some embodiments, the supporting structure 51 of the light guide 5 is at least partly incorporated into supporting element 22 of a lamp 2, e.g. being a single element.

The light guide 5 according to the present disclosure may be suitable for use in a lamp 2 for vehicles, such as cars, trucks, planes, trains, and/or boats. The light guide 5 according to the present disclosure may be particularly useful for automobiles, such as passenger cars and trucks.

The lamp 2 may include at least one supporting element 22, to which light sources 3 are connected, e.g. suitably coupled via a supporting structure like, for example, a PCB, to provide power and/or control signals for illumination.

The lamp 2 may be either a front lamp or a rear lamp, each one performing one or more functions. The functions may include one or more of the following: tail lights, driving lights, brake lights, etc.

The lamp 2 may further include a protection element, e.g. a transparent screen (not shown), adapted to allow the light emitted by the light guide 5 to exit while protecting the latter against external agents.

The lamp 2 may include at least one light guide 5. In some embodiments, the lamp 2, may include the supporting element 22, with the supporting structure 51 fixed thereto. The lamp 2 may also include the body 50 of the light guide 5 fixed to the supporting structure 51 by means of the connection elements 56, and with the body 50 of the light guide 5 having the desired conformation. Alternatively, the supporting element 22 may include the supporting structure 51. For example, the supporting structure 51 may be integral with the supporting element 22

The lamp 2 may comprise a control system, which may be adapted to control, at least partly, the light sources 3, which in turn are adapted to be coupled to one or more light guides 5. The light guides 3 are suitably controlled by the control system to appropriately perform the one or more functions of lamp 2.

As aforementioned, the at least one light source 3 preferably comprises, in addition to the photon emitting device, also a bearing structure, e.g. a PCB. The bearing structure may incorporate, or be incorporated into, the supporting structure 51 of light guide 5 and/or the supporting element 22 of lamp 2.

One aspect of the present disclosure relates to a method for assembling a light guide 5 according to the present disclosure.

The method comprises the following steps, which may be carried out in succession:

- providing a light guide 5 according to the present disclosure;
- selecting the desired conformation of light guide 5;
- positioning at least one body 50 of light guide 5 onto supporting structure 51 in such a way as to define the desired conformation by bending the at least one body 50 at least in a plane, and preferably in space;
- coupling connection elements 56 to supporting structure 51 to maintain the body 50 in the desired conformation.

The present method makes it possible to create a light guide 5 with the desired conformation, which can be changed over time and/or be adapted to the user's requirements.

The light guide 5 comprising a supporting structure 51 and a body 50, as previously specified herein, permits executing the method for assembling a light guide according to the present disclosure.

The present method may allow a user, through the above-mentioned steps of selecting the conformation and positioning at least one body, to design the desired shape of light guide 5 starting from a basic or standard shape of body 50, since the latter can be bent to take the desired shape.

When performing the step of coupling connection elements 56, it is possible to hold the desired conformation of body 50 on supporting structure 51, so that it can be maintained over time. Likewise, it is also possible to modify the conformation of body 50 over time by changing the coupling points between connection elements 56 and supporting structure 51.

In an embodiment of the method according to the present disclosure, the step of coupling connection elements 56 may include inserting at least two connecting elements 56 into connection portions 512 of supporting structure 51, for the purpose of obtaining the desired conformation of body 50. Considering now the preferred embodiment of light guide 5, by inserting protrusions 56 into proper holes 512 it is possible, due to shape coupling, to maintain the desired conformation of light guide 5.

With reference to the exemplary, but non-limiting, embodiments shown in the annexed drawings, FIG. 1 shows a perspective view of one possible embodiment of light guide 5 according to the present disclosure applied to a lamp 2. In this figure one can see body 50 having a flap-like or strip-like shape and extending along a longitudinal direction, which comprises a plurality of connection elements 56 arranged on that face of body 50 which faces towards supporting structure 51. In the illustrated embodiment, preferably, at least one of the connection elements 56 constitutes light inlet portion 52 of body 50. Light emission portion 54 is, on the contrary, at least that face of body 50 which is opposite to the face carrying the connection elements 56. The supporting structure 51 comprises a plurality of connection portions 512 evenly distributed over the surface defined by the supporting structure 51. The same supporting surface 51 is fastened to supporting element 22 of lamp 2 to which the light guide 5 is applied. Light sources 3 are arranged on the non-visible face of supporting structure 51 and of supporting element 22.

In general it is possible, through pliable portions 58 of body 50, to cause body 50 to assume the desired conformation, and the interaction between the connection elements 56 and the supporting structure 51 is such as to keep body 50 of light guide 5 in the desired conformation.

Figure 2A:
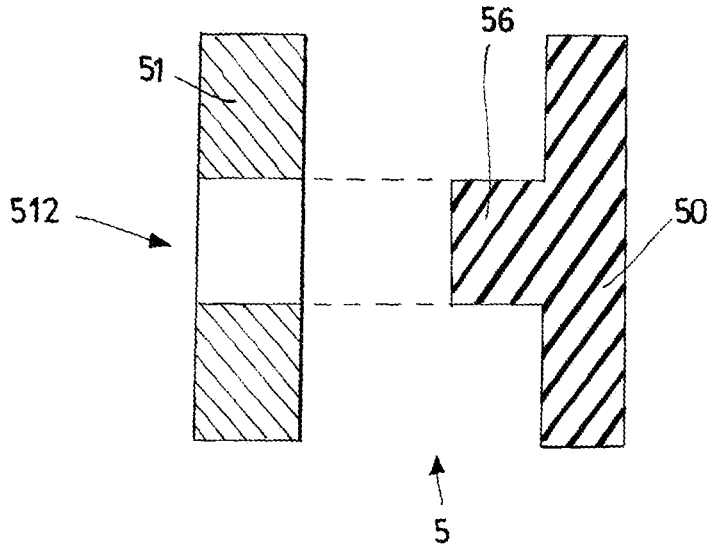
FIG. 2A shows a sectional view of a shape coupling between a body comprising connection elements, and a supporting structure comprising connection portions, in accordance with an aspect of the disclosure.

FIG. 2A shows, in a sectional view, one possible shape coupling between body 50, comprising connection elements 56, and supporting structure 51, comprising connection portions 512, of a light guide 5 according to the present disclosure. This figure is merely illustrative and may be subject to modifications depending on the position and conformation of connection elements 56 and of complementary connection portions 512.

Figure 2B:
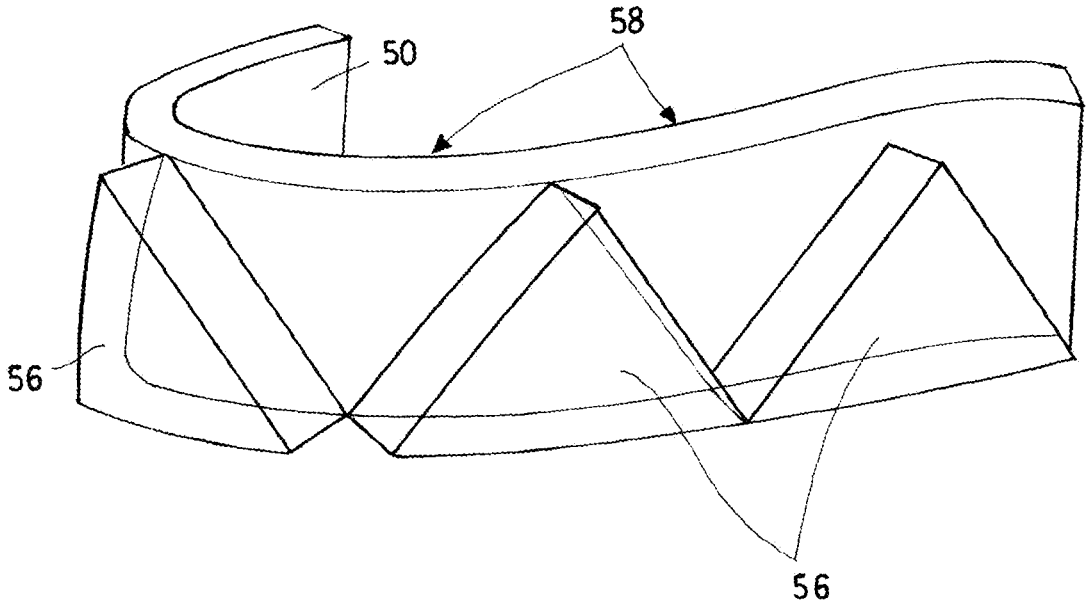
FIG. 2B shows a sectional view of the body having a plurality of connection elements integrated therein, in accordance with an aspect of the disclosure.

FIG. 2B shows an embodiment of the body 50, which is made of silicone-based material and has a plurality of integral connection elements 56. The dimensions, extension and shape of body 50 and of connection elements 56 are merely illustrative and may vary according to specific requirements. In this Figure, it can be easily understood how the whole body 50 defines pliable portions 58, due to the elastic properties of the silicone-based material used for making such body 50. In particular, the portions of body 50 located between two connection elements 56 are particularly adapted to become deformed in order to allow body 50 to take any shape in space, even a sharply curved one, as visible in the drawing.

Figure 3A:
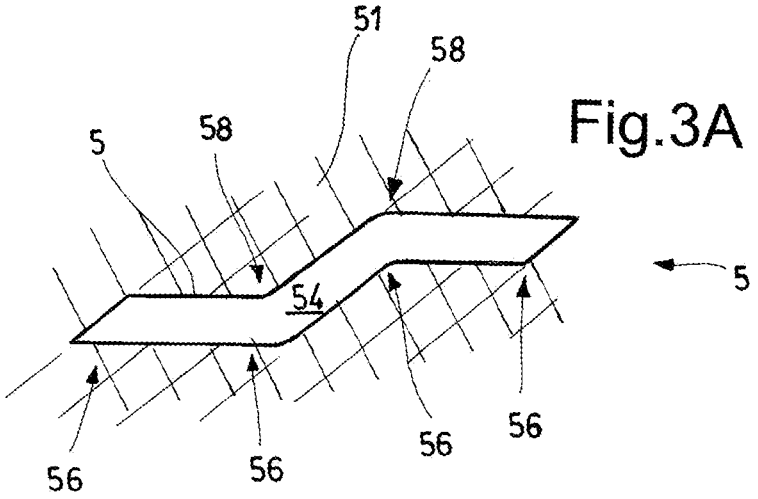
FIG. 3A shows the body with a stylized "S" shape formed by association with the supporting structure to form a light guide, in accordance with one aspect of the disclosure.
Figure 3B:
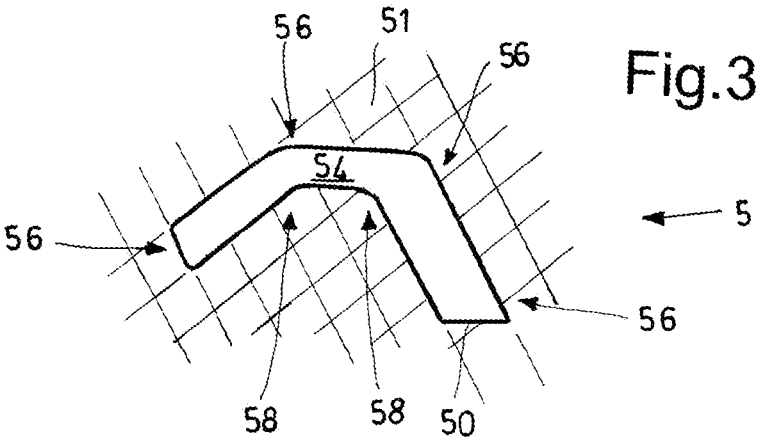
FIG. 3B shows the body with a stylized upside-down "U" shape formed by association with the supporting structure to form a light guide, in accordance with one aspect of the disclosure.
Figure 3C:
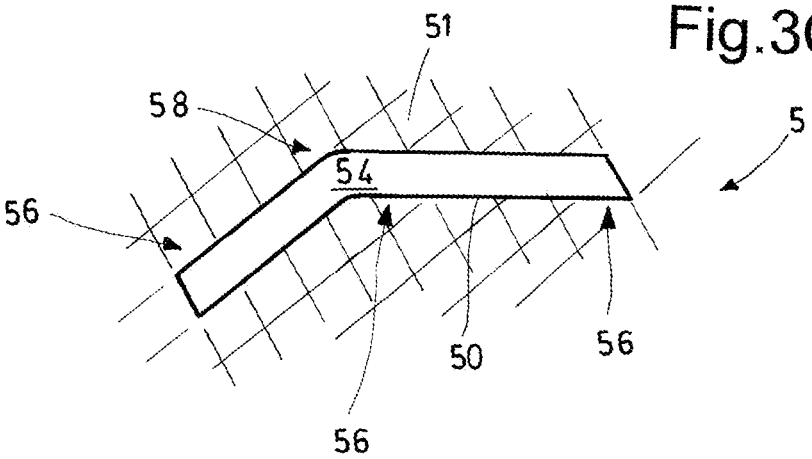
FIG. 3C shows the body with a stylized "L" shape formed by association with the supporting structure to form a light guide, in accordance with one aspect of the disclosure.

From FIGS. 3A-3C, which show some exemplary, but non-limiting, embodiments, it is possible to understand how the body 50 can assume different shapes, thus permitting considerable changes in the conformation of light guide 5. It must however be pointed out that the original shape of body 50 is merely indicative, and that such body 50 may have a shape other than the one shown in the preceding figures.

In the embodiment illustrated in FIGS. 3A-3C, it is clear that light emission portion 54 is that face of body 50 which is opposite to the face that carries connection elements 56, which interact with supporting structure 51, e.g. with respective connection portions. In these figures one can see a supporting structure 51 having a plurality of connection portions that constitute a grid with triangular units.

In this figure one can also see that there is, between at least two connection elements 56, a pliable portion 58 which allows body 50 to bend, so that it can take the desired conformation.

FIG. 4A shows, in one possible sectional view, a possible coupling between body 50 and supporting structure 51 for a first example configuration of light guide 5 according to the present disclosure, wherein supporting structure 51 is located on the face opposite to light emission portion 54 of light guide 5, wherein body 50 assumes a first configuration, wherein the wider face becomes the light emission portion 54. In the present embodiment, the light inlet portion 52 may be one or more of the connection elements 56 by means of which the body 50 is coupled to the supporting structure 51, or else any other face of body 50 other than that face of body 50 which is prearranged for becoming light emission portion 54. In the present disclosure, supporting structure 51 comprises connection portions 512 that define through holes.

FIGS. 4B-4D show the illuminated portions of the light guide 5 in the different conformations shown in FIGS. 3A-3C. FIGS. 4B-4D show that one continuous face of body 50 defines light emission portion 54, and that, due to the various weakening portions 58 and connection elements 56, light guide 5 can take different conformations.

Figure 5A:
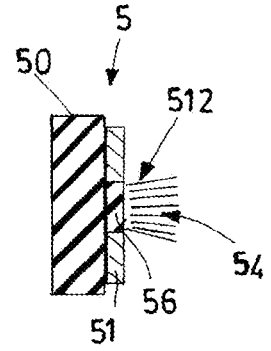
FIGS. 5A-5D show a second example configuration of a light guide according to the present disclosure, wherein the supporting structure is located in front of the light emission portion of the light guide, with the same configuration of the body as shown in FIG. 4A; in particular.

FIG. 5A shows a sectional view illustrating the coupling between body 50 and supporting structure 51 of a light guide 5, according to the present disclosure. In the embodiment shown in FIGS. 5A-5D, the supporting structure 51 is in front of light emission portion 54 of light guide 5, with the same configuration of body 50 as shown in FIG. 4A.

In the embodiment shown in FIGS. 5A-5D, since the connection portions 512 are through holes, connection element 56, which is adapted to be inserted into and coupled to such holes by shape coupling, becomes a light emission portion 54. The embodiment shown in FIGS. 5A-5D may provide a different visual effect in comparison with the embodiment illustrated in FIGS. 4A-4D. The peculiar visual effect obtained by the embodiment shown in FIGS. 5A-5D is clearly visible in FIGS. 5B-5D, which show the illuminated portions of light guide 5 in the different conformations shown in FIGS. 3A-3C.

Figure 5B:
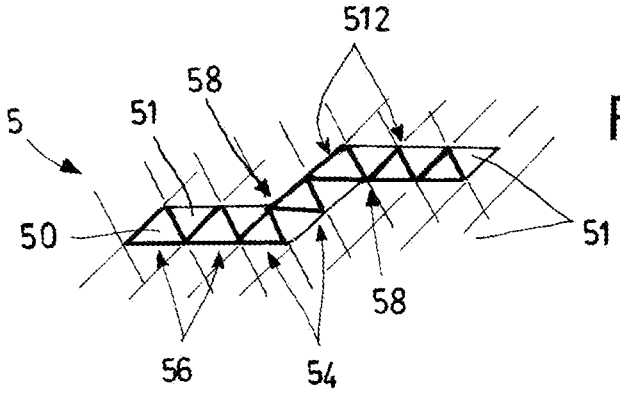
Figure 5C:
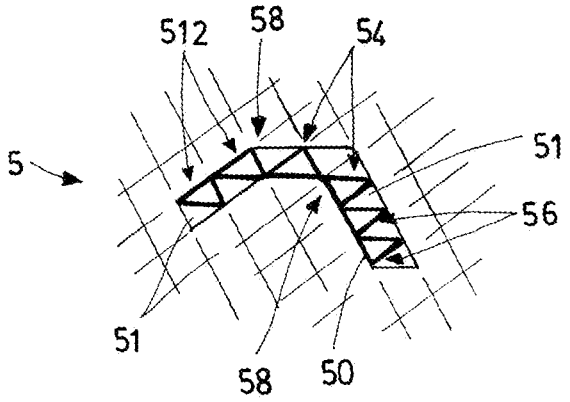
Figure 5D:
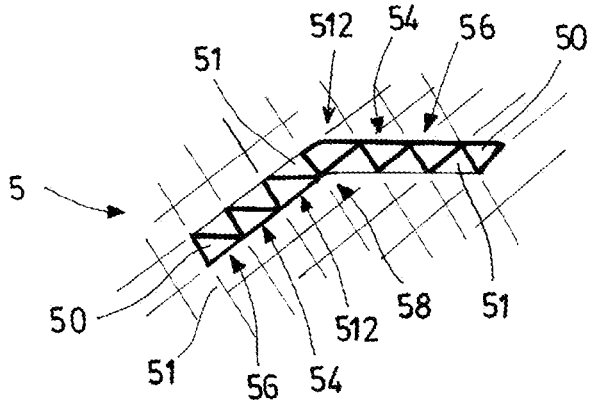

It can be seen in FIGS. 5B-5D, that only connection elements 56 are visible to an observer, since the remaining portions of body 50 are masked, i.e. covered, by the supporting structure 51. It can be seen in FIGS. 5B-5D, that only the triangular parts of connection elements 56 are visible, thus providing light guide 5 with a plurality of light emission portions 54 distinct from one another.

FIGS. 5B-5D also show that connection portions 512 define zones where the light emitted from light guide 5, and in particular from body 50, can be seen by the observer. The remaining part of supporting structure 51, and in particular the area where the connection portions 512 are not present and/or where the connection portions 512 are not through holes and/or where such connection portion 512 faces towards a portion of body 50 that is not a light emission portion 54, can thus mask body 50, thereby preventing the observer from visually perceive the light emission.

Figure 6A:
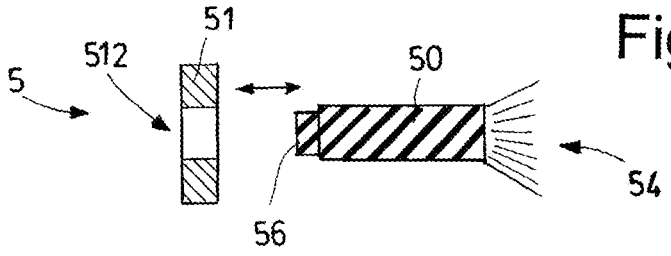
FIGS. 6A-6D show a third example configuration of a light guide according to the present disclosure, wherein the supporting structure is located on the face opposite to the light emission portion of the light guide; in particular.

FIG. 6A shows one possible sectional view showing a possible coupling between body 50 and supporting structure 51 for a first example configuration of a light guide 5 in which supporting structure 51 is located on the face opposite to light emission portion 54, wherein body 50 assumes a second configuration, wherein the narrower face becomes the light emission portion 54. In the present embodiment, in comparison with FIG. 4A, it is clear that the thickness of light emission portion 54 is reduced, but the same is farther away from supporting structure 51, thus providing a different visual effect, which will be due to both the smaller thickness of light emission portion 54 and its distance from supporting structure 51.

In the embodiment shown in FIGS. 6A-6D, the light inlet portion 52 may include one or more of the connection elements 56 or any other face of body 50. In this embodiment as well, supporting structure 51 preferably comprises connection portions 512 defining through holes.

Figure 6B:
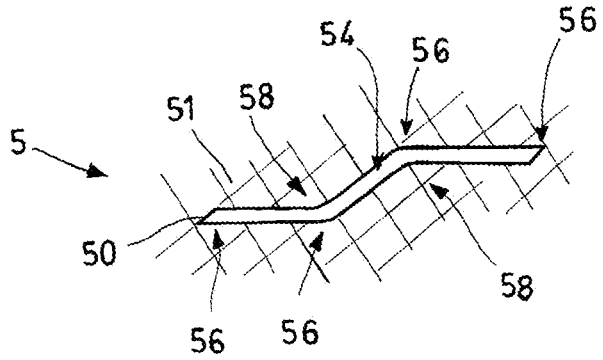
Figure 6C:
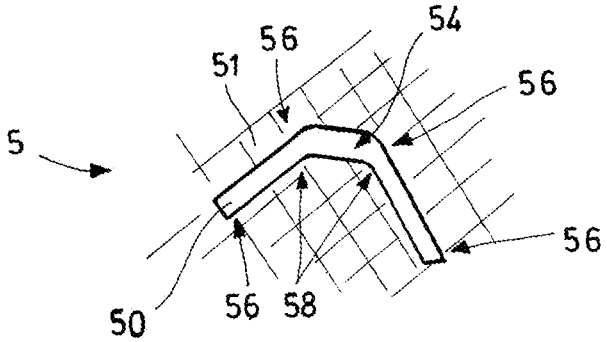
Figure 6D:
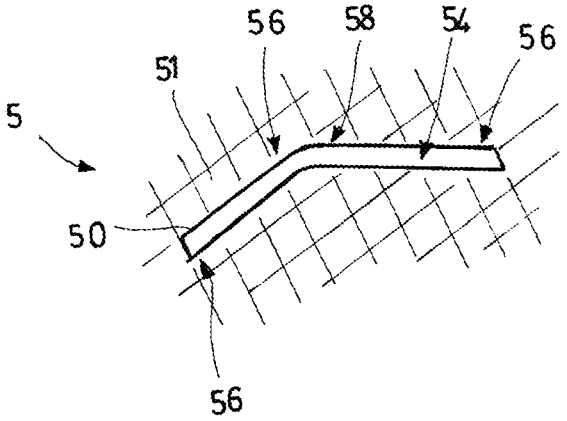

In the embodiment shown in FIGS. 6A-6D, connection elements 56 are located on a face of the body 50 having a reduced thickness compared with the embodiment shown in FIG. 4A. Different configurations of the light guide 5 can be obtained for this embodiment as well, similar to those shown in FIGS. 3A-3C, as represented in FIGS. 6B-6D.

Figure 7A:
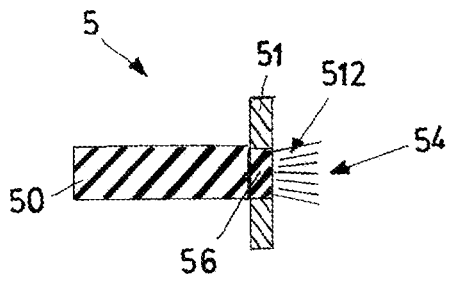
FIGS. 7A-7D show a fourth example configuration of a light guide according to the present disclosure, wherein the supporting structure is located in front of the light emission portion of the light guide, with a similar configuration of the body shown in FIG. 6A; in particular.

FIG. 7A shows a sectional view illustrating a coupling between a body 50 and a supporting structure 51 of a light guide 5, with the body 50 having the conformation shown in FIG. 6A. In the embodiment shown in FIGS. 7A-7D, the supporting structure 51 is in front of light emission portion 54. In the present embodiment, since the connection portions 512 are through holes, connection element 56 becomes a light emission portion 54.

The embodiment shown in FIGS. 7A-7D provides different visual effect in comparison with the preceding embodiment shown in FIGS. 6A-6D and the other embodiments previously illustrated herein.

Figure 7B:
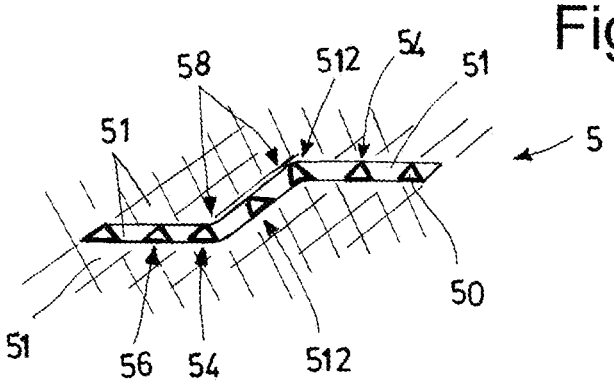
Figure 7C:
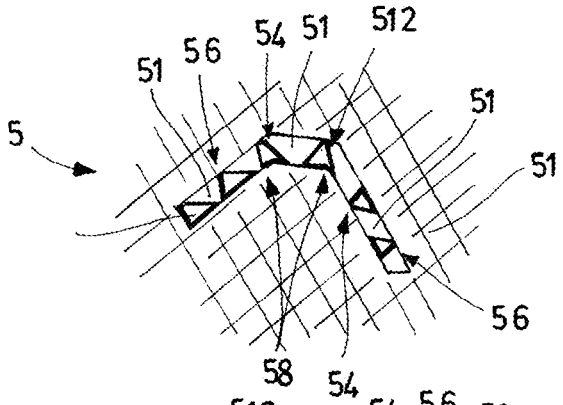
Figure 7D:
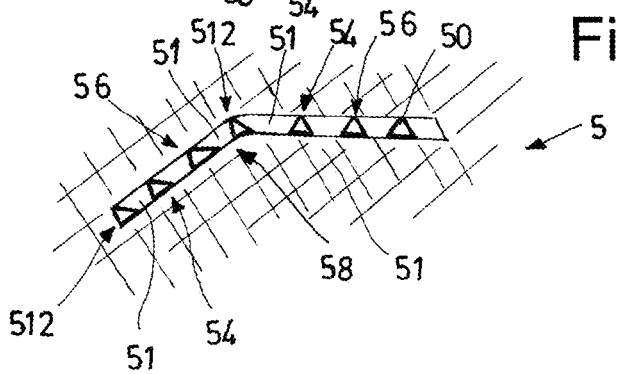

The visual effect obtained by the embodiment shown in FIGS. 7A-7D is illustrated in FIGS. 7B-7D, which show the illuminated portions of light guide 5 in the different conformations shown in FIGS. 3A-3C, wherein one can see how supporting structure 51 masks body 50, allowing the observer to see only some portions of body 50, in a way similar to that shown in FIGS. 5A-5D.

Figure 8A:
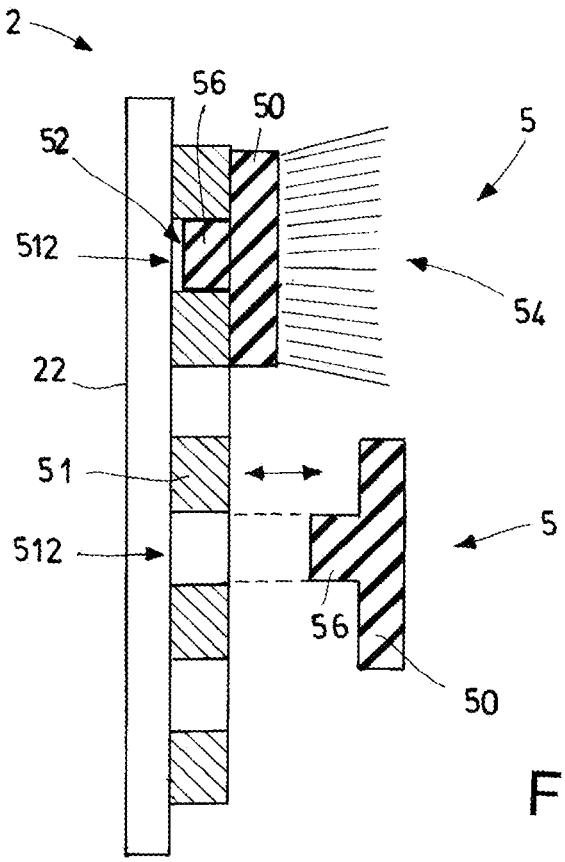
FIGS. 8A and 8B show a portion of a lamp for automobiles, according to the present disclosure, and which includes two light guides; in particular.

Lastly, FIG. 8A shows a section of the lamp 2, including supporting element 22, whereupon the supporting structure 51 is fixed, e.g. by means of fastening elements, which has a plurality of connection portions 512 to which a plurality of light guides 5 can be coupled by inserting the connection elements 56 into corresponding ones of the connection portions 512.

In the upper part of FIG. 8A there is a light guide 5 whose body 50 is assembled to supporting structure 51. The light inlet portion 52 corresponds to connection element 56 when the same connection element 56 is inserted in connection portion 512. In the lower part of FIG. 8A there is a light guide 5 whose body 50 has not yet been assembled to supporting structure 51.

Figure 8B:
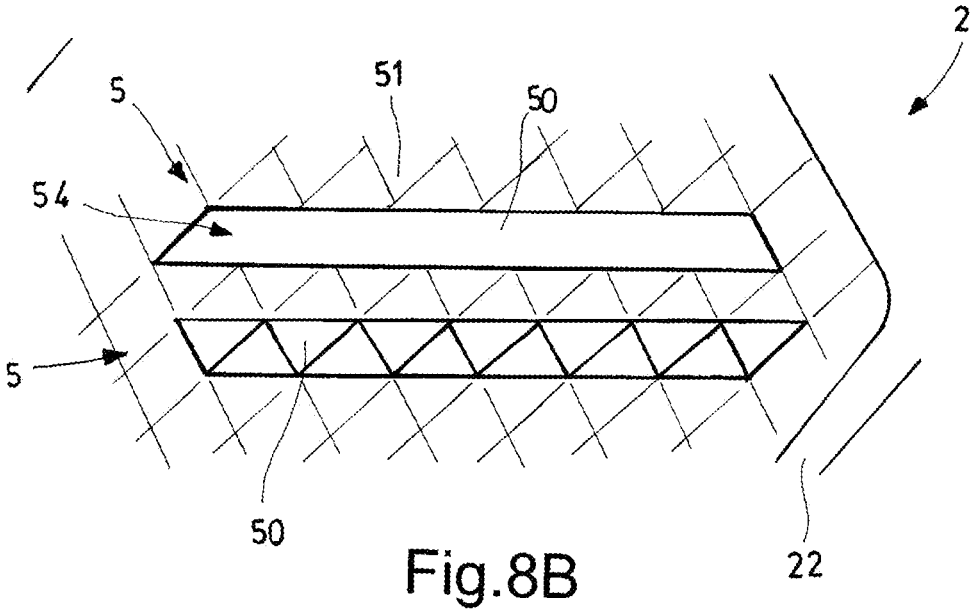

FIG. 8B shows a portion of a lamp 2 for automobiles which comprises two light guides 5 according to the present disclosure, wherein body 50 of light guide 5 in the upper portion has been connected to the supporting structure 51, while body 50 of light guide 5 located in the lower portion has not yet been connected to the supporting structure 51, in a way substantially similar to that shown in FIG. 8A. FIG. 8B illustrates light guides 5 that are arranged linearly, i.e. with no bends, and which are parallel to each other. However, the light guides 5 may have a different configuration or arrangement.

The lamp 2 and light guide 5 of the present disclosure provides for simple and quick assembly, while obtaining the desired aesthetic effect, by using a standardized body 50 that can be suitably fixed to a supporting structure so that light guide 5 will have the desired conformation and will provide the desired aesthetic result. Therefore, it is possible to create a plurality of different light guides having different conformations by using a single type of body 50 and a single type of supporting structure 51, hence providing different visual effects. Such different light guides 5 can be obtained by appropriately connecting connection elements 56 to supporting structure 51, and in particular to connection portions 512, thanks to pliable portions 58 of the body 50 and/or to the mutual disposition of the body 50 and the supporting structure 51. These, among other benefits will be readily appreciated by those skilled in the art of vehicle lighting, upon viewing the disclosure herein.

REFERENCE NUMERALS

Lamp 2
Supporting element 22
Light source 3
Light guide 5
Body 50
Supporting structure 51
Connection portions 512
Light inlet portion 52
Light emission portion 54
Connection elements 56
Pliable portion 58

Any other embodiment not explicitly described and/or illustrated in the present patent application, which will seem obvious to a person skilled in the art in the light of the contents of the present patent application, e.g. obtainable by combining different embodiments of the light guide described and/or illustrated herein, shall be considered to fall within the protection scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A light guide for a lamp of an automobile, comprising:

at least one body made of an elastic material and adapted to conduct, at least partly, light rays within itself by total internal reflection;

a supporting structure, adapted to connect the at least one body to the lamp;

the at least one body including: at least one light inlet portion, from which light rays emitted by at least one light source enter the at least one body, and a plurality of light emission portions from which the light rays at least partly conducted in the at least one body exit the light guide, so as to be visible to an observer;

at least two connection elements adapted to fasten the at least one body to the supporting structure;

at least one pliable portion located between the at least two connection elements and providing for the at least one body to deform into a plurality of different conformations, and allowing the at least two connection elements to move relative to each other; and wherein the at least two connection elements interact with the supporting structure to hold the body of the light guide in a selected conformation;

wherein the supporting structure defines a plurality of connection portions, with each of the connection portions adapted to engage a corresponding one of the at least two connection elements to secure the at least one body to the supporting structure in one of a plurality of different configurations.

2. The light guide according to claim 1, wherein the at least one body is made of silicone-based material.

3. The light guide according to claim 1, wherein the at least two connection elements are incorporated into the body of the light guide.

4. The light guide according to claim 3, wherein the at least two connection elements are formed in the structure of the body as one of protrusions or recesses.

5. The light guide according to claim 4, wherein:

the connection portions are formed as holes;

the body includes a face defining the at least two connection elements as protrusions extending from the face and adapted to fit into corresponding ones of the connection portions; and the at least two connection elements each have a complementary shape to the corresponding ones of the connection portions.

6. The light guide according to claim 5, wherein the plurality of light emission portions includes at least one of the connection elements, and the supporting structure is configured to mask, at least partly, the light emitted by the at least one body.

7. The light guide according to claim 1 wherein the plurality of connection portions are distributed over the supporting structure in an orderly distribution.

8. A lamp for an automobile comprising:

at least one supporting element;

a light source connected to the at least one supporting element; and the light guide according to claim 1.

9. The lamp according to claim 8, wherein the body of the light guide is secured to the at least one supporting element by the at least two connection elements and with the selected conformation.

10. A method for assembling a light guide for a lamp of an automobile, comprising:

positioning at least one body of the light guide onto a supporting structure with a selected conformation by at least one of bending or curving the at least one body;

coupling at least two connection elements of the body to the supporting structure to maintain the at least one body in the selected conformation; and wherein the supporting structure defines a plurality of connection portions, with each of the connection portions adapted to engage a corresponding one of the at least two connection elements to secure the at least one body to the supporting structure in one of a plurality of different configurations.

11. The method according to claim 10, wherein coupling the at least two connection elements includes inserting the at least two connection elements into connection portions of the supporting structure.

* * * * *